US007089823B2

(12) United States Patent
Potts

(10) Patent No.: US 7,089,823 B2
(45) Date of Patent: Aug. 15, 2006

(54) VIBRATORY MECHANISM CONTROLLER

(75) Inventor: Dean R. Potts, Maple Grove, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 10/157,406

(22) Filed: May 29, 2002

(65) Prior Publication Data

US 2003/0223816 A1 Dec. 4, 2003

(51) Int. Cl.
*G05G 1/10* (2006.01)
*E01C 19/38* (2006.01)
*F16H 33/10* (2006.01)

(52) U.S. Cl. ..... 74/553; 404/84.1; 404/117; 74/61; 74/87

(58) Field of Classification Search ..... 404/117, 404/75, 72, 84.1; 73/573, 78; 318/128, 318/686, 114; 702/43; 188/379; 74/553, 74/87, 61
See application file for complete search history.

(56) References Cited

U.S. PATENT DOCUMENTS

| | | | | |
|---|---|---|---|---|
| 3,426,660 | A | 2/1969 | Scott | 94/50 |
| 3,616,730 | A | 11/1971 | Boone et al. | 94/50 |
| 3,656,419 | A | 4/1972 | Boone | 94/50 |
| 3,778,177 | A | 12/1973 | Haker et al. | 404/117 |
| 3,909,147 | A | 9/1975 | Takata | 404/117 |
| 4,058,019 | A | 11/1977 | Braun | 74/87 |
| 4,089,616 | A | 5/1978 | Fairchild et al. | 404/117 |
| 4,300,083 | A * | 11/1981 | Heiges | 318/686 |
| 4,330,738 | A * | 5/1982 | Paramythioti et al. | 318/128 |
| 4,550,812 | A * | 11/1985 | Mard | 188/379 |
| 4,870,601 | A * | 9/1989 | Sandstrom | 702/43 |
| 5,164,641 | A * | 11/1992 | Quibel et al. | 318/128 |
| 5,618,133 | A | 4/1997 | Mitsui et al. | 404/117 |
| 5,695,298 | A * | 12/1997 | Sandstrom | 404/72 |
| 5,727,900 | A | 3/1998 | Sandstrom | 404/84.1 |
| 5,797,699 | A | 8/1998 | Blancke et al. | 404/117 |
| 5,942,679 | A * | 8/1999 | Sandstrom | 73/78 |
| 6,431,790 | B1 * | 8/2002 | Anderegg et al. | 404/75 |
| 6,558,072 | B1 * | 5/2003 | Staffenhagen et al. | 404/117 |
| 6,619,125 | B1 * | 9/2003 | Laugwitz | 73/573 |
| 6,637,280 | B1 * | 10/2003 | Potts | 74/87 |
| 6,750,621 | B1 * | 6/2004 | Gandrud | 318/114 |
| 6,752,567 | B1 * | 6/2004 | Miyamoto et al. | 404/84.1 |
| 2003/0048082 | A1 * | 3/2003 | Gandrud | 318/128 |
| 2003/0082001 | A1 * | 5/2003 | Potts | 404/117 |

FOREIGN PATENT DOCUMENTS

EP 0 404 023 * 12/1990

OTHER PUBLICATIONS

Halliday Resnick Physics, Parts I & II, pp. 770-780, Publisher John Wiley & Sons, Inc.., 1967.*

* cited by examiner

*Primary Examiner*—Vinh T. Luong
(74) *Attorney, Agent, or Firm*—Marshall,Gerstein&Borun; Kevin C. Earle

(57) ABSTRACT

A controller for use in a vibratory mechanism includes an amplitude control circuit that generates an amplitude control signal that varies from a minimum value to a maximum value. The vibratory mechanism is adapted to vibrate at an amplitude based on an amplitude control signal characteristic. Additionally, the controller includes a frequency control circuit that is operatively coupled to the amplitude control-circuit to produce a frequency control signal that varies based on the amplitude control signal characteristic.

13 Claims, 4 Drawing Sheets

VIBRATORY MECHANISM CONTROLLER

TECHNICAL FIELD

The present invention relates generally to controlling vibratory mechanisms and, more particularly, to control systems and methods that automatically vary the vibration frequency of a vibratory mechanism based on vibration amplitude.

BACKGROUND

Vibratory work machines such as, for example, vibratory compactors are well known. Typically, vibratory work machines such as compactors for soil, gravel, asphalt, etc. include vibratory mechanisms that are configured to provide one or more frequency settings as well as one or more amplitude settings. In operation, the vibration amplitude and vibration frequency of a vibratory compactor may be varied by a user to suit a particular application. For example, the vibration amplitude and frequency suitable for compacting gravel for a road may be different from the vibration amplitude and frequency suitable for compacting soil for a footpath.

Typically, vibratory compactors include vibratory mechanisms that produce vibrations using two or more weights that rotate about a common axis. The weights are eccentrically positioned with respect to the common axis and are typically movable with respect to each other about the common axis to produce varying degrees of imbalance during rotation of the weights. As is commonly known, the amplitude of the vibrations produced by such an arrangement of eccentric rotating weights may be varied by positioning the eccentric weights with respect to each other about their common axis to vary the average distribution of mass (i.e., the centroid) with respect to the axis of rotation of the weights. As is generally understood, vibration amplitude in such a system increases as the centroid moves away from the axis of rotation of the weights and decreases toward zero as the centroid moves toward the axis of rotation. It is also well known that varying the rotational speed of the weights about their common axis may change the frequency of the vibrations produced by such an arrangement of rotating eccentric weights.

Known vibratory mechanisms, such as that disclosed by U.S. Pat. No. 3,656,419 to Boone, typically enable users to select a desired vibration frequency from one or more possible frequencies independent of the selection of a desired vibration amplitude. In some cases, the vibratory mechanism may enable a user to adjust only vibration amplitude while vibration frequency remains fixed or uncontrolled, or may enable the user to adjust only vibration frequency while vibration amplitude remains fixed or uncontrolled. Unfortunately, these known vibratory mechanisms do not establish any relationship or dependency between vibration frequency and vibration amplitude. As a result, a user may be permitted to inadvertently select a vibration frequency and amplitude combination that results in a decoupling between a vibratory mechanism and a surface being compacted by the vibratory mechanism. Further, some vibratory mechanisms may permit the user to select an operating condition in which the vibratory mechanism vibrates at a high frequency and a high amplitude, which may result in a vibratory overload (e.g., a bearing overload) within the vibratory mechanism and/or a device, machine, etc. to which the vibratory mechanism is operatively coupled. Still further, some vibratory mechanisms permit users to select one or more vibration frequencies that are coincident with natural resonant frequencies of the vibratory mechanism and/or a device, machine, etc. to which the vibratory mechanism is coupled.

The present invention is directed to overcoming one or more of the problems or disadvantages associated with the prior art.

SUMMARY OF THE INVENTION

A controller for use in a vibratory mechanism may include an amplitude control circuit that generates an amplitude control signal having a characteristic that varies from a minimum value to a maximum value. The vibratory mechanism may be adapted to vibrate at an amplitude based on the amplitude control signal characteristic. Additionally, the controller may include a frequency control circuit that is operatively coupled to the amplitude control circuit to produce a frequency control signal that varies based on the amplitude control signal characteristic.

A system for controlling a vibratory mechanism may include a user interface having a user adjustable vibration amplitude input device that determines an amplitude control output. Additionally, the system may include a programmable controller that receives the amplitude control output determined by the user adjustable vibration amplitude input device and that may be programmed to generate a frequency control output for controlling a vibration frequency of the vibratory mechanism based on the amplitude control output.

A method of controlling a vibratory mechanism includes receiving an amplitude control signal from a user interface having a user adjustable vibration amplitude input device and generating an output signal for controlling a vibration frequency of the vibratory mechanism based on the amplitude control signal.

DETAILED DESCRIPTION

Figure 1:
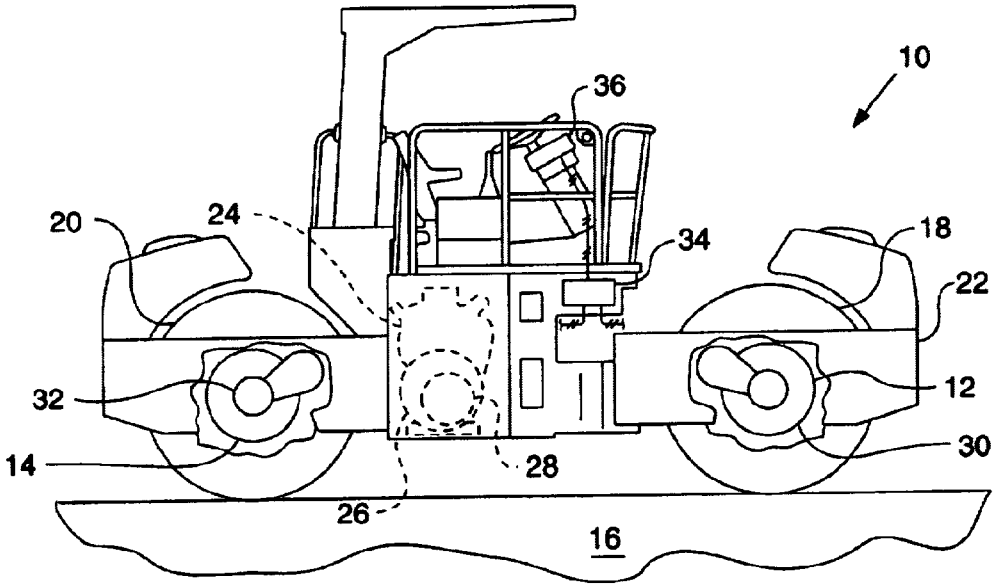
FIG. 1 is an exemplary side elevational view of a vibratory compactor having infinitely variable vibratory mechanisms.

FIG. 1 is an exemplary side elevational view of a vibratory compactor 10 having infinitely variable vibratory mechanisms 12 and 14. As is generally known, a work machine such as the vibratory compactor 10 shown in FIG. 1 may be used to increase the density (i.e., compact) a freshly laid material 16 such as, for example, asphalt or other bituminous mixtures, soil, gravel, etc. The vibratory compactor 10 may include a pair of compacting drums 18 and 20 that surround the respective vibratory mechanisms 12 and 14 and that are rotatably mounted to a main frame 22. The main frame 22 may also support an engine 24 that may be used to generate mechanical and/or electrical power for propelling the compactor 10.

A pair of power sources 26 and 28 may be connected to the engine 24 in a conventional manner or in any other suitable manner. The power sources 26 and 28 may be electric generators, fluid pumps or any other source of power suitable for propelling the compactor 10, providing power to the vibratory mechanisms 12 and 14, providing power to mechanical subsystems, electrical systems, etc. that are associated with the compactor 10.

The vibratory mechanisms 12 and 14 may be operatively coupled to respective motors 30 and 32. While each of the compacting drums 18 and 20 is shown as having only one vibratory mechanism, additional vibratory mechanisms could be used in either or both of the drums 18 and 20, if desired. Where the power sources 26 and 28 provide electrical power, the motors 30 and 32 may be electric motors such as, for example, direct current motors. Alternatively, where the power sources 26 and 28 provide mechanical or hydraulic power, the motors 30 and 32 may be fluid motors. In any case, the motors 30 and 32 may be operatively coupled to the power sources 26 and 28 via electrical wires or cables, relays, fuses, fluid conduits, control valves, etc. (none of which are shown), as needed.

The compactor 10 may also include a controller 34 (examples of which are described in greater detail in connection with FIGS. 4 and 5) that may be used to control the amplitude and the frequency of the vibrations produced by one or both of the vibratory mechanisms 12 and 14. The controller 34 may be operatively coupled to an operator or user interface 36 that enables the user or operator of the compactor 10 to vary the characteristics of the vibrations produced by the vibratory mechanisms 12 and 14, set a desired vibration control mode, determine which one of the compactor drums 18 and 20 or if both of the compactor drums 18 and 20 should be caused to vibrate, to view operational status or conditions associated with the compactor 10, etc. The user interface 36 may be connected to the controller 34 and to other elements, devices, etc. of the compactor 10 via wires, optical fiber, wireless communication links (e.g. radio frequency, infrared, ultrasonic, etc.) or via any other suitable communication media.

It is important to recognize that, although the vibratory mechanism controller 34 is described herein in connection with the vibratory compactor 10 shown in FIG. 1, which is shown by way of example to be a double drum compactor, any other compactor configuration could be used instead. Furthermore, the vibratory mechanism controller 34 described herein may be more generally applied to controlling vibrations produced by other types of vibratory work machines, equipment, devices, mechanisms, etc., without departing from the scope and the spirit of the invention.

Figure 2:
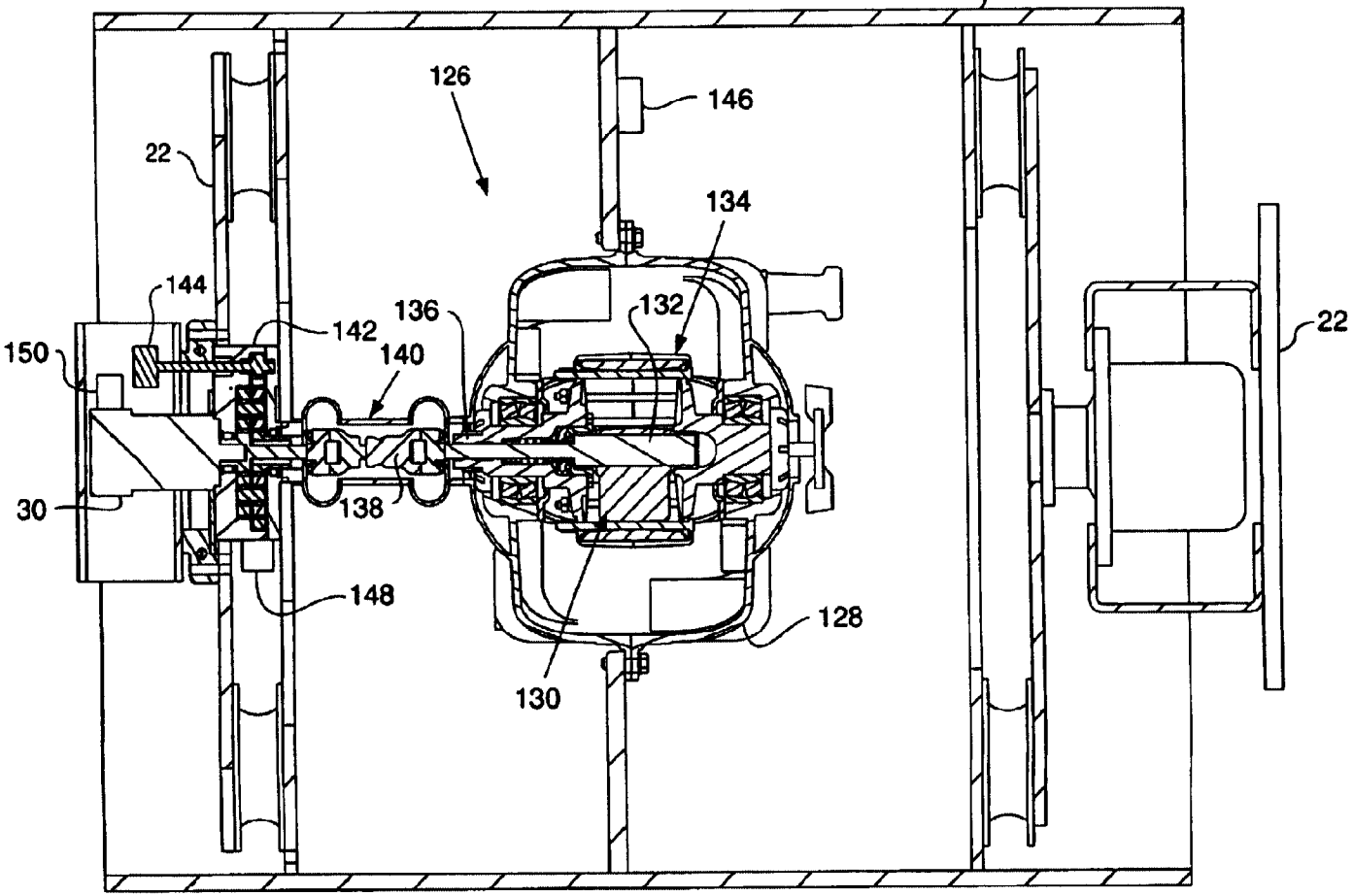
FIG. 2 is an exemplary detailed sectional view of an infinitely variable vibratory mechanism that may be used within the compactor shown in FIG. 1.

FIG. 2 is an exemplary detailed sectional view of an infinitely variable vibratory mechanism 126 that may be used within the compactor 10 shown in FIG. 1. The vibratory mechanism 126 shown in FIG. 2 may be used for one or both of the vibratory mechanisms 12 and 14 shown in FIG. 1. Generally speaking, the vibratory mechanism 126 enables independent continuous or infinite variation of both the amplitude and the frequency of the vibrations produced by the mechanism 126. More specifically, the vibratory mechanism 126 includes structures that enable the relative positions or relative phase of eccentric weights to be continuously or infinitely varied from a minimum to a maximum difference, thereby varying the magnitude of the imbalance and the vibrational forces produced by rotation of the eccentric weights about their axes. Additionally, the frequency characteristic of the vibrations produced by the infinitely variable vibratory mechanism 126 may be varied by changing the rotational speed of the weights (i.e., the frequency of the vibrations produced increases as the rotational speed of the weights increases).

As shown in FIG. 2, the infinitely variable vibratory mechanism 126 may be approximately centrally mounted within the compacting drum 18. Of course, the precise location of the vibratory mechanism 126 may be varied to suit a particular application, desired operational characteristic, etc. Further, an additional vibratory mechanism such as the infinitely variable vibratory mechanism 126 may be similarly mounted within the compacting drum 20. In any event, the infinitely variable vibratory mechanism 126 includes a housing 128 that is rigidly fixed to the compacting drum 18, an inner eccentric weight 130 that is connected to an inner shaft 132, an outer eccentric weight 134 that is connected to an outer shaft 136, an inner flexible coupling 138 for rotating the inner shaft 132 and an outer flexible coupling 140 for rotating the outer shaft 136.

The motor 30 may be connected to the inner and outer couplings 132 and 136 via a gearbox 142. A phase control device 144 may be coupled to the gearbox 142 to enable the relative positions of the inner and outer shafts 138 and 140 and, thus, the relative positions or phase of the inner and outer eccentric weights 130 and 134, to be continuously or infinitely varied. In the case where the gearbox 142 is a planetary gearbox, the phase control device 144 may be an electric motor or a fluid motor that rotates a sun or pinion gear within the gearbox 142 to vary the phase or relative positions of the inner and outer shafts 132 and 136. Alternatively, the phase control device 144 may use a linear actuator and a rack to drive a pinion gear within the gearbox 142, or any other phase control device may be used to vary the phase of the shafts 132 and 136 and the eccentric weights 130 and 134.

Various sensors or other devices may be electrically, mechanically or otherwise coupled to one or more of the variable vibratory mechanism 126, the gearbox 142, the compacting drums 18 and 20, the main frame 22 or any other structure associated with the compactor 10. In general, these sensors or other devices may provide feedback signals or other signals that may be used by the controller 34 and/or the user interface 36 to control the operation of the compactor 10, to provide operational information to the users etc. By way of example only, an accelerometer 146 may be fixed to a portion of the compacting drum 18. In this manner, the accelerometer 146 may be used to measure the actual vibrational characteristics or output of (e.g., the amplitude and the frequency of the vibrations produced by) the compactor 10. These measured vibrational characteristics may be used, for example, by the controller 34 as a feedback signal to more precisely control the vibrations of the compacting drum 18. Of course, additional accelerometers may be fixed to any desired portions of the compacting drums 18 and 20 or any other portions of the compactor 10.

Additionally, a phase sensor 148 may be connected to the gearbox 142 to measure the relative positions or relative phase of the inner and outer shafts 132 and 136 and the inner and outer weights 130 and 134. Further, if desired, a speed sensor 150 may be connected to the gearbox 142 to measure the rotational speed of the shafts 132 and 136 and the eccentric weights 130 and 134. In operation, phase measurements provided by the phase sensor 148 may be used by the controller 34 as a feedback signal to better control the amplitude of the vibrations produced by the compactor 10.

Similarly, the measurements provided by the speed sensor 150 may be used by the controller 34 as a feedback signal to monitor and/or control the frequency of the vibrations produced by the compactor 10.

Figure 3:
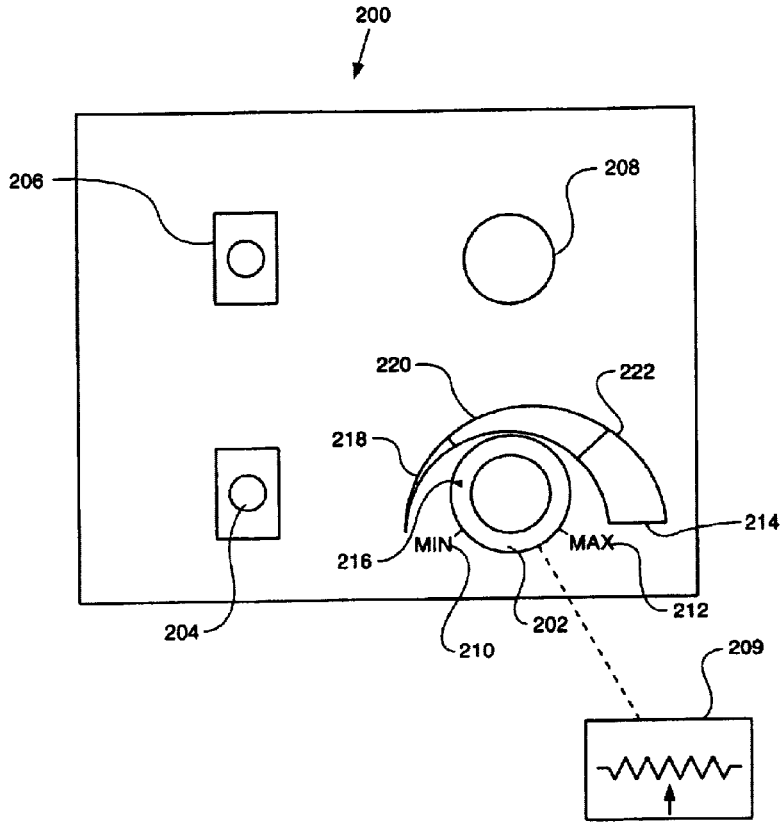
FIG. 3 is an exemplary diagrammatic view of a user interface panel that may be used with the compactor shown in FIG. 1.

FIG. 3 is an exemplary diagrammatic view of a user interface panel 200 that may be used with the compactor 10 shown in FIG. 1. The user interface panel 200 shown in FIG. 3 may be used as a man-machine interface portion of the user interface 36. As shown in FIG. 3, the user interface panel 200 may include a continuously or infinitely variable vibratory control knob 202, a drum control switch 204, a vibratory mode switch 206 and a vibratory run indicator or lamp 208, all of which may be arranged as shown in FIG. 3 or, if desired, may be arranged in some other manner.

The vibratory control knob 202 may be coupled to a rotary potentiometer 209 or to any other circuit element or device that provides an output signal that varies as the position of the knob 202 is varied. The panel 200 may include a minimum vibration amplitude indicator 210 and a maximum vibration amplitude indicator 212, which represent minimum and maximum vibration amplitude settings, respectively, for the compactor 10. Additionally, a vibration amplitude index or reference graphic 214 may be applied to the panel 200 adjacent to the knob 202. The reference graphic 214 may have a generally arced shape with a progressively increasing width that represents increasing vibration amplitudes as the vibratory control knob 202 is rotated clockwise from its full counter clockwise position, in which an arrow or index pointer 216 on the vibratory control knob 202 is aligned with the minimum vibration amplitude indicator 210, and a full clockwise position, in which the index pointer 216 is aligned with the maximum vibration amplitude indicator 212. Thus, relatively wider portions of the reference graphic 214 are indicative of relatively larger amplitude vibrations for one or both of the compactor drums 18 and 20.

The vibration amplitude reference graphic 214 may be sub-divided along its length into a plurality of sections or sub-parts 218, 220 and 222, each of which may be representative of a particular discrete vibration frequency. As shown in FIG. 3, the vibration amplitude reference graphic 214 may be divided into three sub-parts so that the first sub-part 218 represents a relatively high vibration frequency (e.g., 4200 vibrations per minute) for a range of vibration amplitudes, the second sub-part 220 represents a somewhat lower vibration frequency (e.g., 3200 vibrations per minute) and the third sub-part 22 represents the lowest vibration frequency (e.g., 2500 vibrations per minute). Thus, as represented by the panel 200 and as discussed in greater detail in connection with FIGS. 4 and 5, as a user or operator rotates the vibratory control knob 202 clockwise, the vibration amplitude of the compactor 10 may be continuously varied from a minimum value to a maximum value. Additionally, as the vibratory control knob 202 is rotated, the vibration frequency of the vibratory mechanisms 12 and 14 used in the compactor 10 may be varied in three discrete steps based on the position of the knob 202 (i.e., based on the vibration amplitude setting). Of course, the vibration amplitude reference graphic 214 may be sub-divided into more or fewer sub-parts to reflect more or fewer possible frequency conditions. Further, to facilitate use of the vibration amplitude reference graphic 214, the sub-parts 218, 220 and 222 of the graphic 214 may be colored, shaded, or otherwise made more visually distinct from each other.

The drum control switch 204 may be used to cause one or both of the compacting drums 18 and 20 to be vibrated. Similarly, the vibratory mode switch 206 may be used to select an automatic operation mode for the compactor 10, in which the amplitude and frequency of the vibrations produced by the compactor 10 are automatically adjusted by the controller 34 based on the type or characteristics of the surface 12 being compacted. The vibratory run lamp 208 may be a neon lamp, light-emitting diode, a low voltage lamp, a liquid crystal display or any other suitable device that, when activated, indicates that one or both of the compacting drums 18 and 20 are vibrating.

It should be recognized that while one manner of implementing the panel 200 is shown in FIG. 3, many other possible configurations may be used instead without departing from the scope and the spirit of the invention. For example, textual and/or graphical information provided on the panel 200 may be printed on the surface of the panel 200 using, for example, a silkscreening technique, pad printing, printed labels, etc., or some or all of the textual and/or graphical information may be molded, etched or otherwise permanently embedded in surface of the panel 200.

Still further, the switches 204 and 206 may be implemented using rocker switches, toggle switches, membrane switches, slide switches, or any other suitable switch configuration. Likewise, the vibratory control knob 202 may be replaced with a linear slider, a keypad, etc. Still further, the entire panel 200 may be implemented using an electronic display or video display such as, for example, a plasma display, a liquid crystal display, a cathode ray tube, etc. If such a video display is used to implement the panel 200, backlighting may be provided and/or a touch screen may be used to receive user inputs. In the case where a video display and a touch screen are used for the panel 200, the switches 204 and 206, the vibratory control knob 202, the run lamp 208, etc. may be displayed graphical representations that a user may interact with via the touch screen. Touch screen/video display interfaces are well known and, thus, will not be described in greater detail herein.

Figure 4:
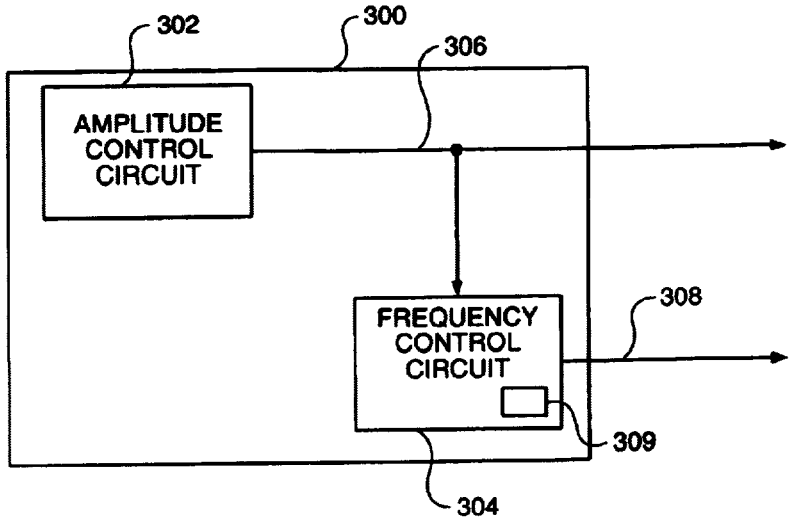
FIG. 4 is an exemplary schematic block diagram of a controller that may be used to control the vibratory mechanisms within compactor shown in FIG. 1.

FIG. 4 is an exemplary schematic block diagram of a controller 300 that may be used as the controller 34 to control the vibration frequency and amplitude of the compactor 10 shown in FIG. 1. The controller 300 may include an amplitude control circuit 302 and a frequency control circuit 304 that is operatively coupled to the amplitude control circuit 302. Generally speaking, the amplitude control circuit 302 may generate an amplitude control signal 306 such that a characteristic of the amplitude control signal 306 varies from a minimum value to a maximum value. The amplitude control signal 306 may be adapted to cause a vibratory device or mechanism such as, for example, the infinitely variable vibratory mechanism 126 shown in FIG. 2, to vibrate at an amplitude corresponding to the value of the amplitude control signal characteristic. Also, generally, the frequency control circuit 304 may be operatively coupled to the amplitude control circuit 306 via wires, or in any other suitable manner, to produce a frequency control signal 308 that varies based on the value of the amplitude control signal characteristic.

More specifically, the amplitude control circuit 302 may be implemented using a variable resistance device such as, for example, a rotary or a sliding potentiometer, which may be similar or identical to the potentiometer 209 shown in FIG. 3. In the case where a potentiometer is used to implement the amplitude control circuit 302, the amplitude control signal 306 may provide a characteristic such as, for example, a resistance value that varies (i.e., either increases or decreases) as a user adjusts an input such as, for example, the vibratory control knob 202 shown in FIG. 3 in connection with the user interface panel 200. Of course, additional circuitry could be provided to condition the resistive output of a potentiometer so that the amplitude control signal 306 provides a different characteristic. For example, the varying resistance of a potentiometer could be converted into a varying voltage, a varying current, a series of pulses having a varying frequency or duty cycle, a signal magnitude, or any other suitable signal characteristic desired.

The amplitude control signal 306 may be adapted to cause the phase control device 144 (FIG. 2) to vary the relative positions of the eccentric weights 130 and 134 about the shafts 132 and 136, thereby changing the degree of imbalance and the amplitude of the vibrations produced by the vibratory mechanism 126. By way of example only, if the phase control device 144 is implemented using an electric motor, the amplitude control circuit 302 may provide an amplitude control signal 306 having a voltage and/or a current characteristic that varies based on a desired vibration amplitude. Alternatively, in the case where the electric motor is a stepper motor, the amplitude control signal may be a series of pulses that cause the shaft of the stepper motor to rotate to a desired angular position. Still further, in the case where the phase control device 144 is a fluid motor, the amplitude control circuit 302 may provide an output signal that causes the fluid motor to be actuated.

The frequency control circuit 304 may be implemented using a mechanical switch 309 that is mechanically coupled to the amplitude control circuit 302. For example, in the case where the amplitude control circuit 302 is implemented using a rotary potentiometer, the frequency control circuit 304 may use a rotary switch that is ganged or otherwise mechanically coupled to the rotary potentiometer so that rotation of the potentiometer causes rotation of the switch. In this manner, the switch 309 may have a plurality of switch positions and the switch 309 may be engaged in one of the plurality of switch positions based on the position of the potentiometer in the amplitude control circuit 302. Importantly, because the position of the potentiometer in the amplitude control circuit 302 may also control the position of the switch 309 in the frequency control circuit 304, the value of the amplitude control signal characteristic may be related to the frequency control circuit switch position. Preferably, the frequency control signal 308 is based on the value of the amplitude control signal characteristic to prevent decoupling (in a case where the controller 300 is being used to control a vibratory mechanism within a vibratory compactor or the like) and/or a vibratory overload condition (e.g., a bearing overload) within a vibratory mechanism or device, such as, for example, the vibratory mechanism 126 shown in FIG. 2, and/or a vibratory work machine or device, such as, for example, the compactor 10 shown in FIG. 1. Also, preferably, the frequency control signal 308 prevents the user from selecting an operating frequency that is coincident with a natural resonant frequency of the vibratory mechanism 126 and/or a device, machine, etc. to which the vibratory mechanism 126 is operatively coupled.

In the case where the frequency control circuit 304 is implemented using a multi-position switch, each of the switch positions may correspond to one of a plurality of discrete states (e.g., a voltage value, a current value, a frequency, etc.), each of which, in turn, may uniquely correspond to one of a plurality of vibration frequencies. The frequency control signal 308 may have a voltage characteristic, a current characteristic, a frequency characteristic, or any other desired characteristic that varies based on the value of the amplitude control signal characteristic. In the case where the frequency control circuit 304 is implemented using a multi-position switch, each of the switch positions may provide a contact closure that connects a different resistive value within the frequency control circuit 304, that changes a reference voltage, that changes a reference current or some other signal parameter so that each of the switch positions uniquely corresponds to one of a plurality of conditions or states of the frequency control signal 308.

Alternatively or additionally, the frequency control circuit 304 may be implemented using a processor that is programmed to vary a characteristic of the frequency control signal 308 based on the value of the amplitude control signal characteristic. In the case where a processor is used, one or more software routines may be included that use look-up tables, characteristic equations describing the operational characteristics of a vibratory device or mechanism, or any other calculation or algorithm that may be used to determine a vibration frequency based on a vibration amplitude. Of course, the amplitude control circuit 302 and the frequency control circuit 304 may be implemented using any desired combination of analog or digital circuitry using a variety of well-known circuit design techniques.

Figure 5:
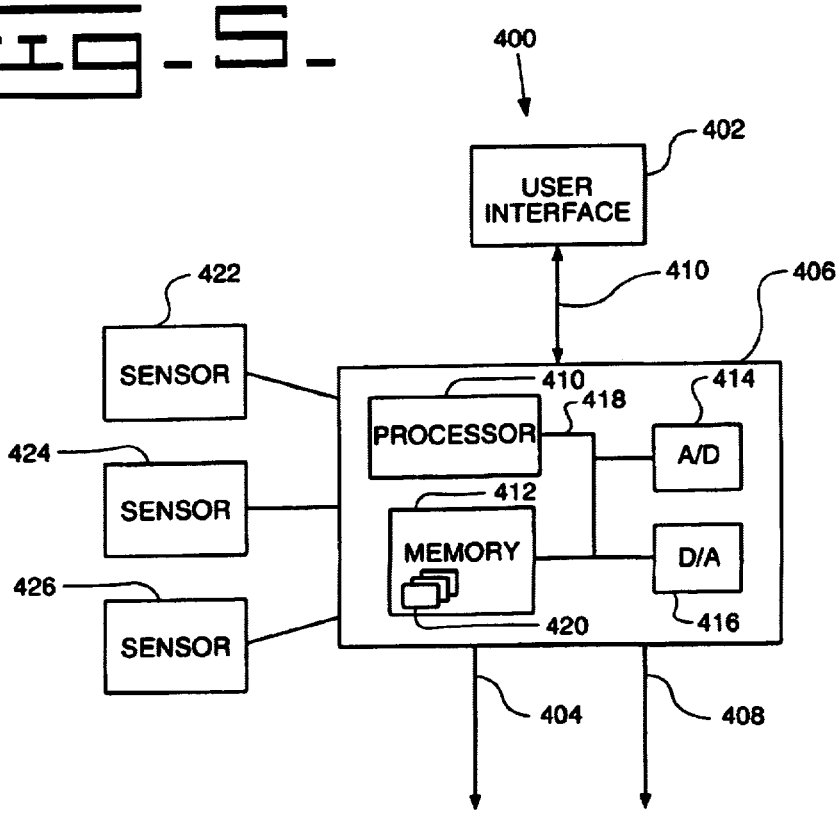
FIG. 5 is an exemplary schematic block diagram of another controller that may be used to the control the vibratory mechanisms within the compactor shown in FIG. 1.

FIG. 5 is an exemplary schematic block diagram of another controller or system 400 that may be used to the control the vibration frequency and amplitude of the compactor 10 shown in FIG. 1. Generally speaking, the controller or system 400 may be used for controlling a vibratory mechanism or device and/or a vibratory work machine. As shown in FIG. 5, the controller or system 400 may include a user interface 402 having a user adjustable vibration amplitude input device (not shown) that generates an amplitude control output 404. The system 400 may also include a programmable controller 406 that is programmed to use the amplitude control output 404 to generate a frequency control output 408 for controlling a vibration frequency of a vibratory mechanism or device.

The user interface 402 shown in FIG. 5 may be used as the user interface 36 shown in FIG. 1 and may, if desired, use the panel 200 shown in FIG. 3. In that case, the user adjustable vibration amplitude input device may be the vibratory control knob 202 shown in FIG. 3, which may be connected to a rotary potentiometer, a multi-position switch, or any other desired device that may be used to provide a varying signal characteristic in response to a user's operation of the vibratory control knob 202. Alternatively, the user interface 402 may be similar or identical to commonly known digital computer interfaces and, thus, may include a video display, a keypad, a joy stick, a touch screen overlay, a mouse, a voice responsive input device, etc. In any event, the user interface 402 is coupled to the programmable controller 406 via a link 410, which may be a hardwired link or data bus or a wireless link using any suitable communication protocol.

The programmable controller 406 may include a processor 410, a memory 412, an analog-to-digital converter 414 and a digital-to-analog converter 416, all of which may be communicatively coupled via a data bus 418. The memory 412 may have one or more software routines 420 stored thereon that may be executed or preformed by the processor 410. The amplitude control output 404 may be a resistance signal, a voltage signal, a current signal, a switch contact, or any other type of signal or output that may be used, for example, to control the phase control device 144 (FIG. 2) to vary the amplitude of the vibrations produced by a vibratory mechanism such as the vibratory mechanism 126 shown in FIG. 2.

The programmable controller 406 may vary the frequency control output 408 among a plurality of discrete states, each of which may uniquely correspond to one of a plurality of signal values which, in turn may, each correspond to one of a plurality of vibration frequencies of the vibratory mechanism, device, work machine, etc. being controlled by the programmable controller 406. By way of example only, the frequency control output 408 may be a stepped voltage signal, a stepped current signal, a series of pulses having a frequency and/or duty cycle that varies in a discrete or stepped fashion etc. Alternatively, the frequency control output 408 may be a continuous signal such as, for example, a continuously variable voltage, current, resistance, etc. Preferably, the programmable controller 406 varies the frequency control output 408 based on the amplitude control output 404 to prevent a resonance condition in the vibratory mechanism, device, work machine, etc. being controlled.

Still further, a plurality of sensors 422-426 may be connected to the programmable controller 406. The sensors 422-426 may include the sensors 146, 148 and 150 shown and described in connection with FIG. 2 and/or may include other or different sensors as needed to suit a particular application.

INDUSTRIAL APPLICABILITY

Vibratory mechanisms, such as those used within vibratory compactors, typically require frequent adjustment of the amplitude and the frequency of the vibrations produced by the mechanism and/or the device or machine in which the vibratory mechanism operates. For example, in the case of a vibratory compactor, the changing characteristics of a material being compacted, the job-to-job differences in compacted materials, etc. may affect the vibration amplitude and vibration frequency needed.

Generally speaking, with the vibratory mechanism controller described herein, a user of a vibratory mechanism, device or work machine that has an infinitely variable amplitude anchor frequency may, for example, continuously vary the vibration amplitude without causing decoupling (in the case where the vibratory mechanism is used within a compaction device) and/or a vibratory overload condition within the mechanism, device or work machine. More specifically, in the exemplary case of the compactor 10 shown in FIG. 1, an operator may select the drum control and vibratory modes via the switches 204 and 206 (FIG. 2) of the user interface 34. The user may then adjust or rotate the vibratory control knob 202 to a position that corresponds to a desired vibration amplitude while the controller 34 automatically controls the vibration frequency to prevent decoupling, vibratory overload and/or a resonance condition. By way of example only, the range of amplitude settings may be sub-divided so that in a low amplitude range, the controller 34 may cause one or both of the vibratory mechanisms 12 and 14 to vibrate at a frequency of about 4200 Hz. Similarly at a medium vibration amplitude range, the controller 34 may cause one or both of the vibratory mechanisms 12 and 14 to vibrate at a frequency of about 3200 Hz and at a high amplitude range, the controller 34 may cause one or both of the vibratory mechanisms 12 and 14 to vibrate at a frequency of about 2500 Hz. In this manner, the total radial force on the shafts (e.g., the shafts 132 and 136) of the vibratory mechanisms 12 and 14 produced by the vibrations may be limited or maintained below a maximum desirable or permissible force (i.e., bearing overload may be prevented). Further, the possible vibration frequencies (e.g., 4200 Hz, 3200 Hz and 2500 Hz) are selected so that decoupling will not occur for the range of vibration amplitudes corresponding to those frequencies and so that none of the vibration frequencies is coincident with a natural resonant frequency of the vibratory mechanisms 12 and 14 and/or a device, machine, etc. to which the vibratory mechanisms 12 and 14 are operatively coupled.

Numerous modifications and alternative embodiments of the invention will be apparent to those skilled in the art in view of the foregoing description. For example, while the vibratory mechanism controller is described herein as controlling vibration frequency to fall within one of a plurality of discrete frequencies based on a continuously or infinitely variable vibration amplitude, the vibration frequency may be varied in a stepwise continuous fashion or in a continuous fashion so that particular frequency and amplitude combinations that would cause decoupling and/or a vibratory overload condition may be avoided. Accordingly, this description is to be construed as illustrative only and is for the purpose of teaching those skilled in the art the best mode of carrying out the invention. The details of the structure may be varied substantially without departing from the spirit of the invention, and the exclusive use of all modifications, which come within the scope of the appended claims, is reserved.

Other aspects and features of the present invention can be obtained from a study of the drawings, the disclosure, and the appended claims.

What is claimed is:

1. An adjustable controller for use in a vibratory mechanism, comprising:

an amplitude control circuit that includes a user adjustable input device and generates an amplitude control signal based upon a user input to the user adjustable input device, wherein the amplitude control signal has a characteristic that varies from a minimum value to a maximum value, and wherein the vibratory mechanism is adapted to vibrate at an amplitude based on the amplitude control signal characteristic;

a frequency control circuit that is operatively coupled to the amplitude control circuit to produce one of a plurality of frequency control signals having a discrete frequency value; and wherein each discrete frequency value corresponds to an amplitude range.

2. The adjustable controller of claim 1, wherein the user adjustable input device of the amplitude control circuit includes a variable resistance device and wherein the amplitude control signal is one of a voltage, a current, a resistance and a series of pulses.

3. The adjustable controller of claim 2, wherein the variable resistance device is a potentiometer.

4. The adjustable controller of claim 1, wherein the amplitude control signal characteristic is one of a current, a voltage, a signal magnitude, a frequency and a duty cycle.

5. The adjustable controller of claim 1, wherein the frequency control circuit includes a switch having a plurality of switch positions and wherein the switch is mechanically coupled to the amplitude control circuit so that switch is engaged in one of the plurality of switch positions based on the amplitude control signal characteristic.

6. The adjustable controller of claim 1, wherein the frequency control circuit includes a processor programmed to vary a characteristic of the frequency control signal based on the amplitude control signal characteristic.

7. The adjustable controller of claim 6, wherein the characteristic of the frequency control signal is one of a resistance, a voltage, a current, a frequency and a duty cycle.

8. The adjustable controller of claim 1, wherein the frequency control signal varies among a plurality of discrete states and wherein each of the plurality of discrete states uniquely corresponds to one of a plurality of frequencies.

9. The adjustable controller of claim 1, wherein the frequency control circuit is adapted to vary the frequency control signal based on the amplitude control signal characteristic to prevent any one of a vibratory overload condition and a decoupling condition associated with the vibratory mechanism.

10. A manually adjustable controller for use in a vibratory mechanism, comprising:

an amplitude control circuit that includes a user adjustable input device and generates an amplitude control signal based upon a user input to the user adjustable input device, wherein the amplitude control signal has a characteristic that varies from a minimum value to a maximum value, and wherein the vibratory mechanism is adapted to vibrate at an amplitude based on the amplitude control signal characteristic; and a frequency control circuit that is operatively coupled to the amplitude control circuit to produce a frequency control signal that varies based on the amplitude control signal characteristic;

wherein the user adjustable input device of the amplitude control circuit includes a variable resistance device and wherein the amplitude control signal is one of a voltage, a current, a resistance and a series of pulses; and wherein the variable resistance device is a potentiometer.

11. An adjustable controller for use in a vibratory mechanism, comprising:

an amplitude control circuit that includes a user adjustable input device and generates an amplitude control signal based upon a user input to the user adjustable input device, wherein the amplitude control signal has a characteristic that varies from a minimum value to a maximum value, and wherein the vibratory mechanism is adapted to vibrate at an amplitude based on the amplitude control signal characteristic; and a frequency control circuit that is operatively coupled to the amplitude control circuit to produce one of a plurality of frequency control signals having a discrete frequency value that corresponds to an amplitude range;

wherein the frequency control signal changes between discrete frequency values as the amplitude control signal is varied from the minimum to the maximum value.

12. An apparatus for controlling an infinitely variable vibratory mechanism, comprising:

an amplitude control circuit that includes a user adjustable input device and generates an amplitude control signal based upon a user input to the user adjustable input device, wherein the amplitude control signal has a characteristic that varies from a minimum value to a maximum value, and wherein the vibratory mechanism is adapted to vibrate at an amplitude based on the amplitude control signal characteristic; and a frequency control circuit that is operatively coupled to the amplitude control circuit to produce one of a plurality of frequency control signals having a discrete frequency value; and wherein each discrete frequency value corresponds to an amplitude range.

13. The apparatus of claim 12, wherein the frequency control signal changes between fixed frequency values as the amplitude control signal is varied from the minimum to the maximum value.

* * * * *